US006283026B1

(12) United States Patent
Tocheport et al.

(10) Patent No.: US 6,283,026 B1
(45) Date of Patent: Sep. 4, 2001

(54) DEVICE FOR AUTOMATICALLY BLOCKING AIR PASSAGES IN CYLINDER, SPECIFICALLY FOR SUPPORT CYLINDERS AND COMPENSATION MANTLES

(75) Inventors: Jean-Francois Tocheport, Le Bourg; Jean Francille, Jolysable, both of (FR)

(73) Assignee: Polybribron Technologies S.A. (FR)

( * ) Notice: Subject to any disclaimer, the term of this patent is extended or adjusted under 35 U.S.C. 154(b) by 0 days.

(21) Appl. No.: 09/432,323

(22) Filed: Nov. 2, 1999

(30) Foreign Application Priority Data

Nov. 2, 1998 (FR) ..... 9813751
Feb. 12, 1999 (FR) ..... 9901894

(51) Int. Cl.[7] ..... B41F 27/14; B41N 10/00
(52) U.S. Cl. ..... 101/375; 101/378
(58) Field of Search ..... 101/216, 217, 101/375, 376, 378, 401.1, 483, 485, 486, DIG. 36; 492/4, 5, 48, 49; 29/895.23

(56) References Cited

U.S. PATENT DOCUMENTS 4,150,622 * 4/1979 Stollenwerk et al. ..... 101/389.1
4,178,664 * 12/1979 McLoughlin ..... 492/48
4,381,709 * 5/1983 Katz ..... 101/375
4,491,082 * 1/1985 Barch et al. ..... 101/375
5,209,163 * 5/1993 Banike ..... 101/378
5,216,954 * 6/1993 Thompson ..... 101/375
5,379,693 * 1/1995 Hoffmann et al. ..... 101/375
5,551,339 * 9/1996 Schadlich et al. ..... 101/216
5,706,731 * 1/1998 Francille et al. ..... 101/375
5,740,738 * 4/1998 Niemiro ..... 101/375
5,778,779 * 7/1998 Jones et al. ..... 101/375
5,782,181 * 7/1998 Rossini ..... 101/375
5,819,657 * 10/1998 Rossini ..... 101/375
5,974,972 * 11/1999 Van Denend et al. ..... 101/375

FOREIGN PATENT DOCUMENTS 0 711 655 A1 5/1996 (EP) .
0 732 201 A1 9/1996 (EP) .

* cited by examiner

*Primary Examiner*—Stephen R. Funk
(74) *Attorney, Agent, or Firm*—Woodcock Washburn Kurtz Mackiewicz & Norris LLP

(57) ABSTRACT

The present invention relates to an automatic closing device for air passage holes in a support cylinder, or compression sleeves used in printing applications. The automatic closing devices of the invention are inserted into the thickness of the wall of the cylinder and comprises a support, a seat with an interior passage and a valve mobile in translation in the support. The support is capable of assuming two positions, the first in which the valve comes into tight contact with the aforementioned seat and the other in which it is retracted so as to allow for a passage.

21 Claims, 10 Drawing Sheets

DEVICE FOR AUTOMATICALLY BLOCKING AIR PASSAGES IN CYLINDER, SPECIFICALLY FOR SUPPORT CYLINDERS AND COMPENSATION MANTLES

FIELD OF THE INVENTION

The present invention relates to an automatic closing device for air passage holes in a cylinder, specifically for support cylinders and intermediate or compensation sleeves. More specifically, the invention relates to an intermediate sleeve for a printing cylinder equipped with such a closing device.

BACKGROUND OF THE INVENTION

Means for installing sleeves on hollow cylinders are known. These means consist of constructing and utilizing sleeves which are adjusted tight in relation to a support cylinder and which are installed on the aforementioned cylinder by generation of a film of air under pressure in the interface zone. For this purpose, the support cylinder is hollow and forms a closed chamber. Feeding air under pressure from this closed chamber is provided at one of the extremities while the nozzles, generally distributed in the direction of a generator, allow for the release of this air under pressure. Beginning with the coaxial casing of the sleeve, the first hole creates a film of air under pressure at the interface, radially dilates the sleeve, which, in the manner of an air cushion, permits the introduction of this sleeve over the entire length of the cylinder, if need be.

When the supply of compressed air is interrupted, the sleeve resumes its nominal diameter and the radial closing forces suffice to hold it in place, even in operation, i.e., during the rotation.

If this type of assembly is well known, a problem arises when it is necessary to install two sleeves on the same hollow cylinder in a superposed coaxial manner.

Flexographic and heliographic printing processes necessitate frequent changes of development between successive operations.

In arranging printing sleeves of various thicknesses for a given support cylinder one can cover a relatively significant spectrum of development for a single support cylinder.

These printing sleeves thus present some important economic advantages.

Nevertheless, for strong developments, it is necessary to use printing sleeves of significant thickness. These sleeves then become too heavy to be manipulated by a single operator for practical reasons as well as to adhere to load limits imposed by labor law. These sleeves can also have a very significant rigidity which can pose some assembly problems.

This is why intermediate or intercalary sleeves have been developed that are designed to be mounted on a support cylinder and to further support an exterior printing sleeve. These intermediate sleeves rest on the support cylinder. Only the outer sleeves are installed or dismounted.

In practice, the dimension of the intercalary sleeve is selected such that it can be associated with outer sleeves of relatively small thickness while being able to generate a spectrum of developments of relative significance.

Thus, only the outer sleeves are manipulated, their weight being quite inferior to that of the thick printing sleeves.

An intermediate sleeve can likewise be used in association with thin sleeves on which stereotypes for repeated use are permanently fixed. These thin sleeves are installed on the intermediate sleeve as a function of printing runs. This avoids turning to long mounting and dismounting operations of stereotypes on a printing sleeve. The risk of deterioration of stereotypes as well as the risk of errors during the positioning of stereotypes are likewise avoided.

Thus, if one has recourse to an intermediate or compensation sleeve, other problems arise when it is necessary to install a sleeve coaxially on another of the same nature. The coefficients of friction can turn out to be significant. Moreover, installation under pressure can only be conducted on the basis of a sole source of compressed air, namely the chamber constituted by the hollow cylinder.

A first problem which arises comes from the fact that the holes arc distributed along a generating line and are all open which engenders a poor pressure distribution. Indeed, if the first holes are plugged, the compressed air has a tendency to proceed on the other holes and to restrict the formation of a film of air between the sleeve and the cylinder. The limited pressure leads to a smaller radial dilation and to a rise in force. If the pressure is excessively increased, it risks damaging the sleeve at the end of installation when all the holes are closed which is not a satisfactory solution.

One can cite the document EP-0 732 201 which describes an intermediate sleeve of relatively significant thickness on which an outer sleeve can be installed in a relatively immovable manner.

Nevertheless, the assembly of the intermediate sleeve and the outer sleeve is not conducted directly on the support cylinder. Thus, after having installed the outer sleeve on the intermediate sleeve, it is still necessary to proceed to the installation of the group of two sleeves on the support cylinder. In this case, the presence of an intermediate sleeve does not permit lightening the overall weight of the piece which should be mounted on the support cylinder, and the intermediate sleeve does not resolve the problems of manipulation linked to the weight which have been mentioned above.

Document EP-0 711 665 describes an intercalary sleeve which is installed directly on a support cylinder, a thin outer sleeve being mounted immovably on the intermediate sleeve. Such an intermediate sleeve thus permits resolving the manipulation problems mentioned above.

Installing the outer sleeve on the intermediate sleeve is made possible as a result of a system comprising two bushings which are installed in the thickness of the intermediate sleeve on one extremity of this. One of the bushings is fixed in rotation in relation to the intermediate sleeve while the other bushing is free in rotation on the fixed bushing. These two bushings are pierced by radial conduits, those of the inner fixed bushing constantly being in communication with openings created in the support cylinder.

During assembly of the intermediate sleeve on the support cylinder, the mobile bushing is turned in relation to the fixed bushing such that their respective conduits do not coincide.

Thus, the air under pressure in the support cylinder can create a film of air which permits easy assembly of the intermediate sleeve on the cylinder. After installing the intermediate sleeve, the mobile bushing is turned in relation to the fixed bushing such that their respective conduits coincide. Thus, when air under pressure is injected into the support cylinder, a film of air is created on the outer surface of the of the intermediate sleeve which facilitates the installation of a thin outer sleeve on the intermediate sleeve.

Such a system effectively permits having available an intermediate sleeve on which thin outer sleeves selected as a function of the development required can be installed directly on the intermediate sleeve and the support cylinder.

Nevertheless, this system proves to be relatively complicated and onerous to operate. Moreover, the thickness of the intermediate sleeve should be sufficiently significant to permit accommodating the two bushings which limits its possibilities of use.

In the case of the installation of a compensation sleeve, another constraint is that the compensation sleeve should be blocked on the support cylinder after installation while allowing the posterior installation under pressure of the printing sleeve on this compensation sleeve.

BRIEF DESCRIPTION OF THE INVENTION

The purpose of the invention is to palliate these problems and to permit an easy installation of the sleeves either in the case of a single sleeve directly on the support cylinder, or in the case of a compensation sleeve with a coaxial printing sleeve. The solution should be achieved at low cost for the existing equipment pool and at low additional charges for new equipment.

The present invention provides a sleeve support to which a printing sleeve may be coupled, said sleeve support comprises a substantially cylindrical sidewall having a plurality of air passages disposed therethrough. Each one of the air passages has a closing device disposed therein comprising a scat coupled with the sidewall and a valve member having a body portion and a head portion. The valve member is movably disposed longitudinally within in the air passage and is capable of assuming a first position wherein the head portion comes into contact with the seat, and a second position wherein the valve is retracted to permit a passage for the pressurized gas.

In another embodiment, the invention provides a method for mounting a printing sleeve assembly onto a support sleeve. The method comprises providing a support sleeve comprising an interior surface and an exterior surface, a hollow interior, and a plurality of openings formed between the interior and the exterior surface for enabling air communication therethrough. Each one of the passages includes a valve assembly disposed therein that is biased toward a closed position. Next, pressurized air is provided to the passages. A printing sleeve is mounted by sliding an open end of the printing sleeve longitudinally over the support sleeve, and moving the printing sleeve longitudinally over the support sleeve. The printing sleeve contacts a portion of the valve assembly to urge the valve assembly from its closed position to an open position to enable the pressurized air to communicate with the printing sleeve. Then the pressurized air os turned off after the printing sleeve is disposed in its desired position relative to the support sleeve.

In yet another embodiment, the invention provides a method for mounting a printing sleeve assembly. The method comprises providing a support cylinder having a hollow interior and comprising an inner and outer surface and a first set of transverse openings for the passage of air from the hollow interior. The support cylinder is capable of receiving a flow of pressurized air. Next, a flow of pressurized air is provided to the interior of the hollow support cylinder such that the air escapes through the first set of transverse openings. A sleeve support is then introduced over the first set of transverse openings. The sleeve support comprises a substantially cylindrical sidewall having a plurality of air passages disposed therethrough, each one of the air passages having a closing device disposed therein. The closing device comprises a seat coupled with the sidewall, and a valve member having a body portion and a head portion. The valve member is movably disposed longitudinally within in the air passage and is capable of assuming a first position wherein the head portion comes into contact with the seat, and a second position wherein the valve is retracted to permit a passage for the pressurized air whereby the escaping pressurized air causes the head of the valve to come into tight contact with the seat thereby preventing the escape of air through the plurality of openings for passage of air traversing through the thickness of the wall of the sleeve support and generating a film of air between said outer surface of said support cylinder and said interior surface of said intermediate sleeve.

BRIEF DESCRIPTION OF THE DRAWINGS

The invention will now be described with reference to the appended drawings which represent non-limiting examples of the construction of the invention and wherein the different figures represent.

DETAILED DESCRIPTION OF THE INVENTION

Elements common to the different Figures will be designated by the same reference numbers.

Figure 1:
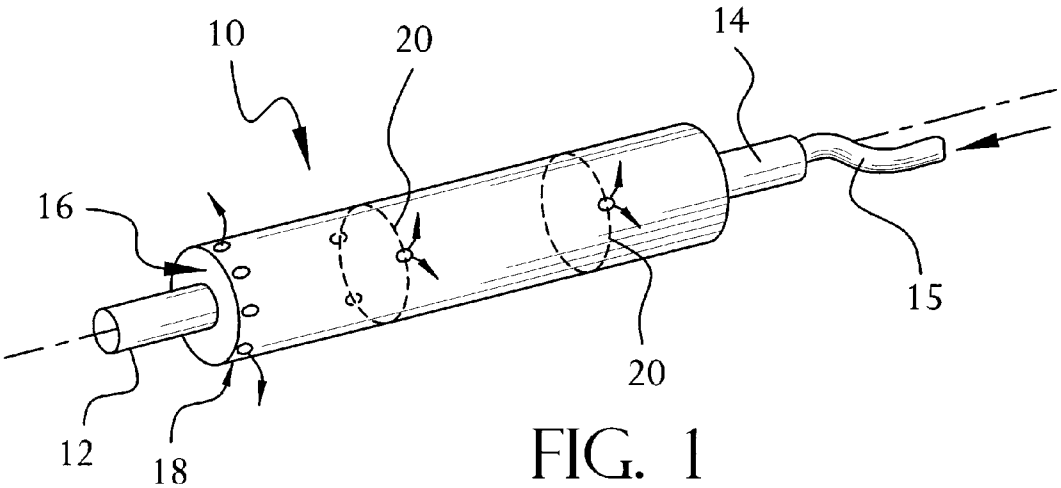
FIG. 1, a schematic perspective view of a support cylinder.
Figure 2:
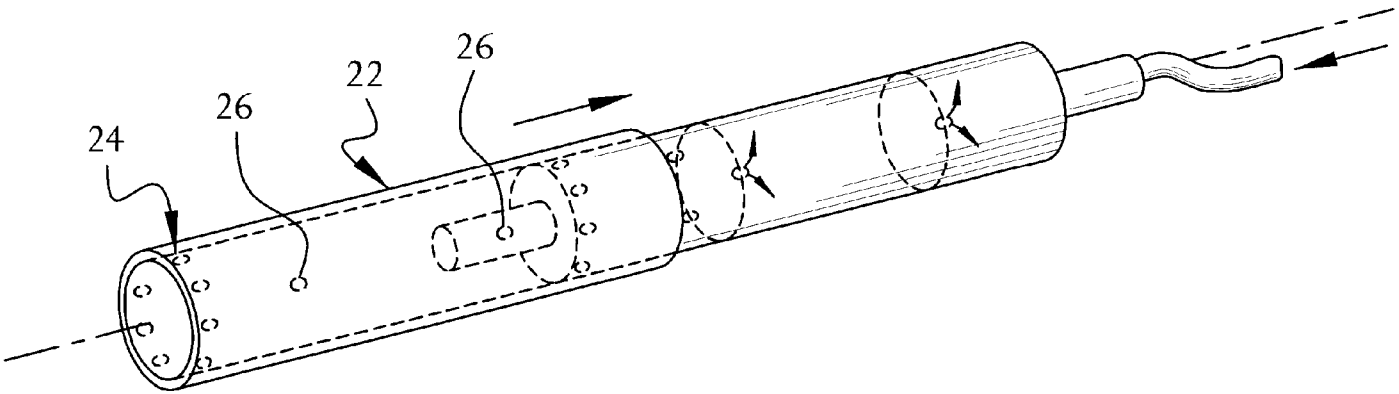
FIG. 2, a schematic perspective view of the same support cylinder of FIG. 1 and a sleeve in the course of installation.

Referring to FIGS. 1 and 2, the cylinder 10 is a metal support cylinder which is hollow and includes an axis 12, 14 of rotation at each of its extremities provided for both to interact with the bearings of the machine in a familiar fashion.

One of the axes 14 includes a central drilled passage with a quick connection terminal (not illustrated) to connect the chamber 16 comprised by the interior of the cylinder to a source of air under pressure 15.

This cylinder includes, in accordance with the invention, a particular distribution which is optimized, without being restrictive, with a first set of six nozzles 18 or traversing openings regularly distributed on the periphery of a single circle and several secondary sets of nozzles 20 or traversing openings identical to those of the first set distributed on the peripheries of successive circles along a generator.

On this cylinder 10, installing a sleeve 22 is planned, in this case, a compensator sleeve. It would be the same if one were to install a printing sleeve except that it would not have nozzles to receive a sleeve in coaxial fashion.

This compensator sleeve 22 includes a first set of nozzles 24 or traversing openings regularly distributed like the nozzles of the support cylinder, as well as several secondary sets 26 likewise in the image of the secondary sets of the support cylinder.

There should be an agreement of at least one part of the different nozzles after complete assembly of the compensator sleeve on the support cylinder. For this purpose, it is advantageous to provide identification indicators on the edge of the support cylinder and the compensator sleeve and even a locking device as this will be described in the remainder of the description.

Figure 3:
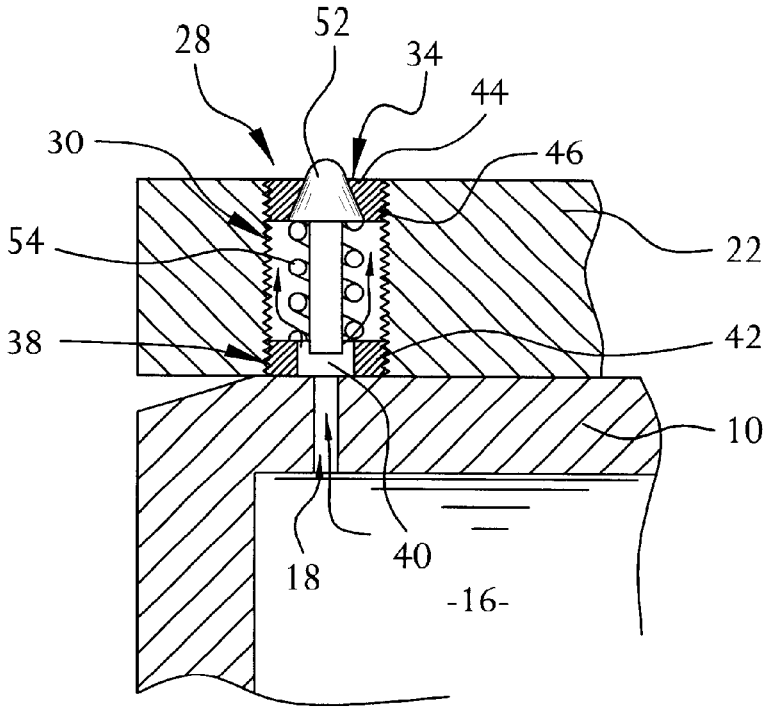
FIG. 3, a view in section of the extremity of a compensation sleeve mounted on a support cylinder.

Referring to FIG. 3, each nozzle of each compensator sleeve is equipped with an individual automatic closing device 28 for each nozzle of each one of the different sets.

Figure 5:
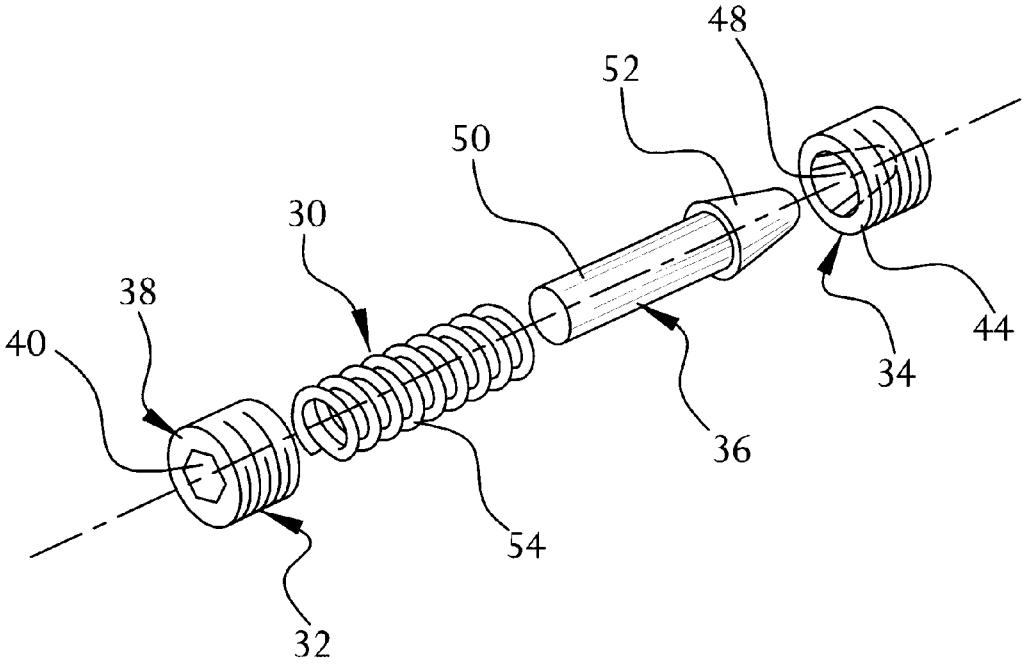
FIG. 5, an exploded view of the various elements constituting the obturator with automatic command.

These individual automatic closing devices each include an obturator 30 of which an exploded view is shown in FIG. 5.

Each obturator 30 includes a support 32, a seat and a mobile valve 36.

The support 32 is a bushing 38 whose interior passage 40 has flat edges, in this case six flat edges.

The support is fixed level with the interior side of the compensation sleeve in a counter boring 42 centered on the corresponding nozzle.

The seat 34 is a bushing 44 fixed in a counter boring 46 level with the inside. This bushing 44 has an interior passage 48 of conical shape as shown in FIG. 5.

The mobile valve 36 includes a body 50 having a diameter permitting sliding (in the interior passage 40 with flat edges) of the bushing and a head 52 conjugate in outline to that of the interior passage 48 of conical shape of the bushing 44 of the seat. This valve can assume two positions, the one in which the valve is retracted, with the head 52 outside the interior passage 48 and the other in which the passage is supported with the head 52 laid on the wall of the interior conical passage, thus assuring tightness.

A spring 54 is interposed between the support 38 and the head 52 of the valve 36 so as to press this valve against the seat 34. The rigidity of this spring is relatively weak because its role is limited to compensating for the weight of the valve to maintain it against the seat when the valve is subjected to gravity in the direction of the head/element.

The assembly of such a compensation sleeve 22 on a support cylinder 10 is conducted in the following manner.

The interior chamber 16 of the support cylinder 10 is placed under pressure with the result that the air escapes through the sets 18 and 20 of nozzles of cylinder 10.

The compensation sleeve 22 is introduced which masks the nozzles of the first set of nozzles 18. A film of air is generated between the outer surface of the support cylinder and the interior surface of the compensation sleeve. The balance is in part ameliorated by the fact that the nozzles are distributed in an asymmetrical manner with a larger number from the entrance without increasing pressure.

Generally, the support cylinders are of metal and the sleeves are of composite material with the result that the coefficient of friction is acceptable and the compensation sleeve is easily installed.

Note that the air under pressure has a tendency to lay the head 52 of the valve 36 against the interior passage 48 of the scat 34 in the same direction as the force exerted by the spring with the result that the air cannot escape. Thus, after inserting the sleeve, all the holes are in agreement and the nozzles of the various sets 24 and 26 are closed. If these nozzles were not closed, the film of air under pressure would be interrupted, thus prohibiting any movement of the sleeve on the support cylinder.

One will note that, in the position represented on FIG. 3, the extremity of the head 52 of each valve slightly protrudes from the outer surface of the compensation sleeve 22 through the interior passage 48 of the seat.

Figure 4:
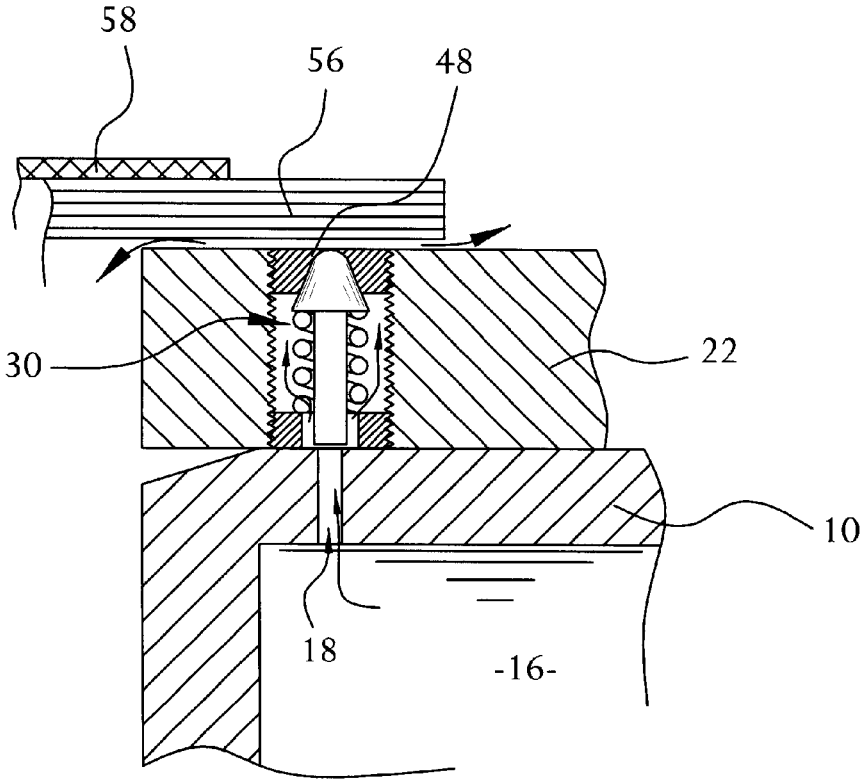
FIG. 4, an identical view to that of FIG. 3, but which a printing sleeve in the process of assembly on the compensation sleeve.

Referring now to FIG. 4, in the case of a compensation sleeve installation, the following stage consists of introducing coaxially a printing sleeve 56 bearing a stereotype or an engraving 58 on the compensation sleeve 22 which is going to be mounted on the support cylinder.

To accomplish this, the compressed air feed is interrupted which induces the immobilization of the compensation sleeve on the support sleeve.

The printing sleeve is then introduced by its extremity on to the compensation sleeve until it covers the nozzles of the first set again. From then on, the valves of the individual automatic obturators of this first set retract to permit a passage through the nozzles of the first set.

The flow of compressed air is then resumed. The air under pressure passes through the nozzles of the support cylinder and through the open obturators of the compensation sleeve to create a film of air between this compensation sleeve (which is immobile) and the printing sleeve which is to be introduced.

One will note that the greater part of the air under pressure is directed toward the open nozzles, which leaves the compensation sleeves immobile while generating a film of air of good quality between the compensation sleeve and the printing sleeve.

In proportion with the introduction of the printing sleeve on the compensation sleeve, the valves are open, which ameliorates the distribution of the film of compressed air at the interface.

When the printing sleeve is totally inserted, the flow of pressurized air is interrupted which assures the immobilization of the printing sleeve on the compensation sleeve, itself immobilized on the support cylinder.

Figure 6:
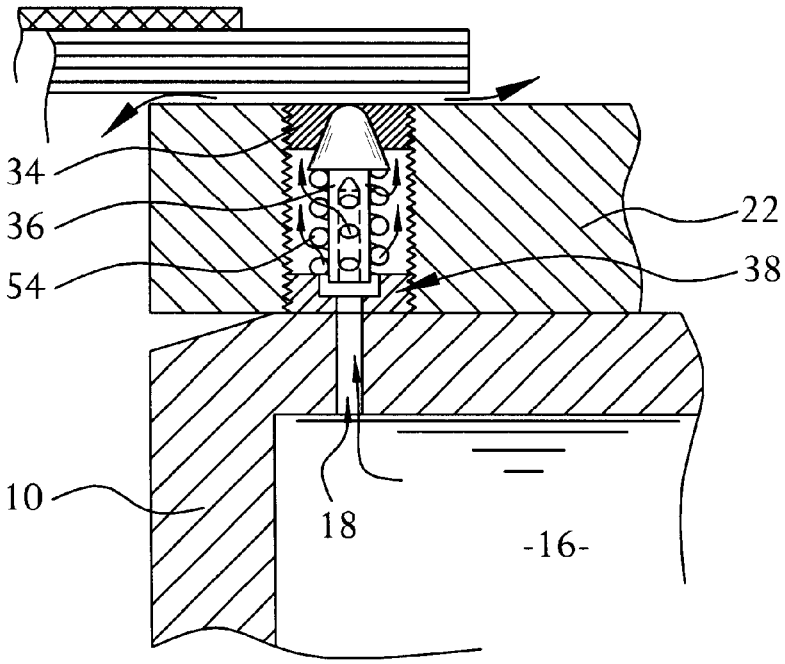
FIG. 6, a view identical to that of FIG. 4 but with a different automatic command obturator.

FIG. 6 is a variant of construction of the valve, the body of which is outfitted with a blind longitudinal hole and radial air passage holes. In this case, the valve body rests on the support without traversing it.

Guidance is then obtained in this particular embodiment by the differences between the body of the valve and those of the counter boring in which it is mobile in translation and by the coaxial spring.

Figure 7A:
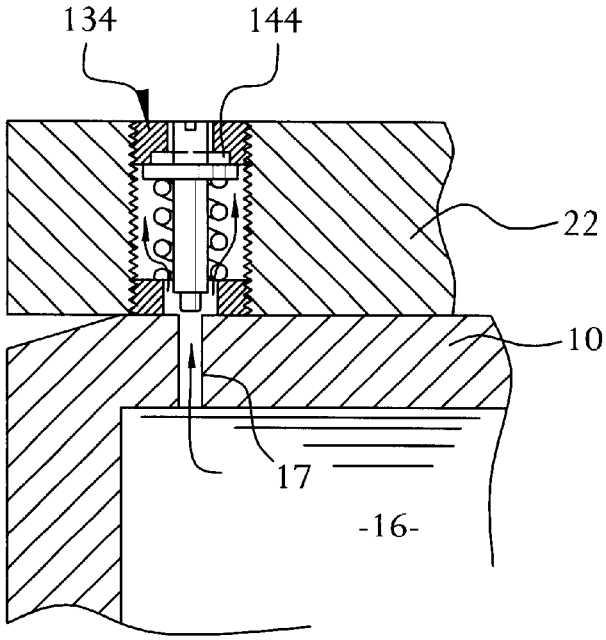
FIGS. 7A and 7B, a view of a special obturator with manual locking in the two positions of installation and of positioning.
Figure 7B:
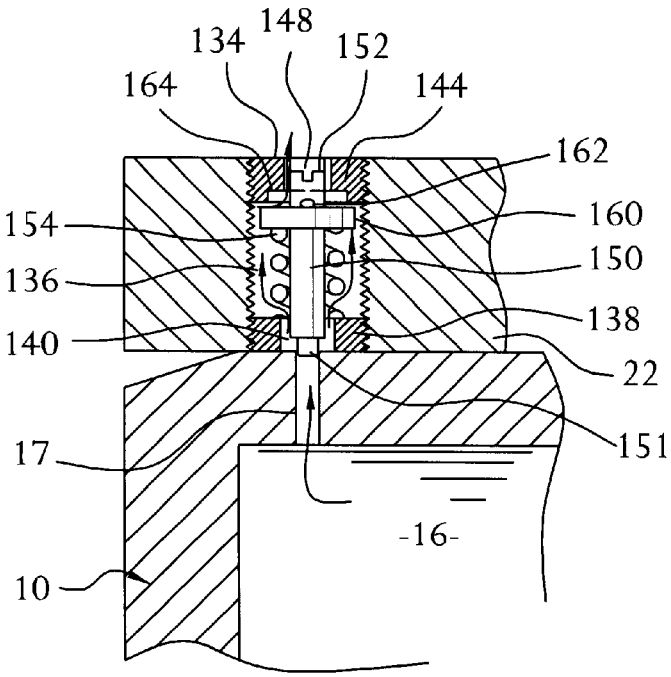
Figure 8:
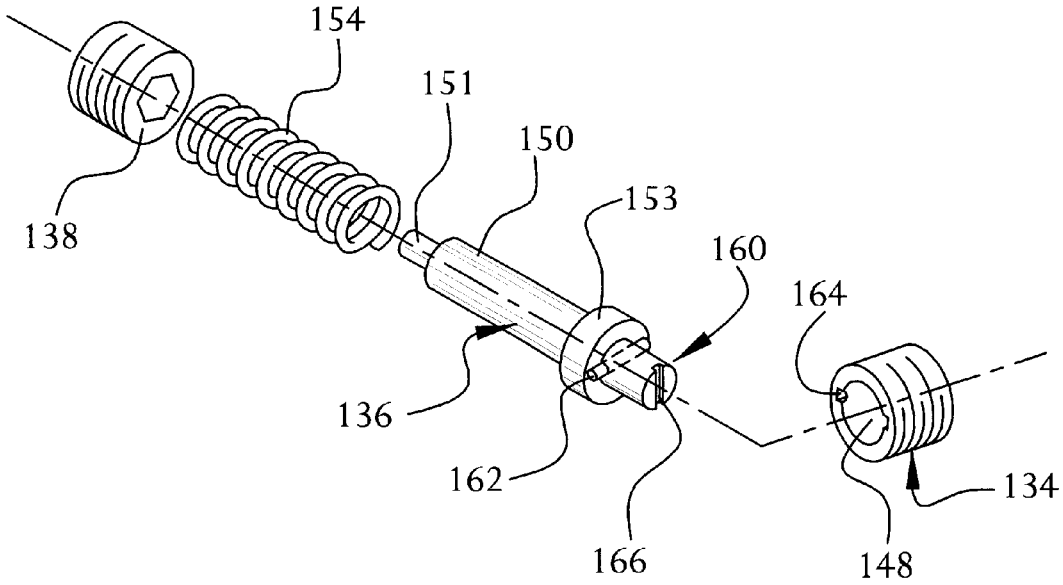
FIG. 8, an exploded view of the different elements constituting the automatic command obturator of FIGS. 7A and 7B.

On FIGS. 7A and 7B, a manual locking variant is represented, with identical reference numbers bearing the reference numbers increased by 100. This embodiment provides a mobile valve 136 which is pressed by a spring 154 as in the preceding installation. The bushing 138 is identical to the preceding bushing 138 with an interior passage 140 with six flat edges to permit the insertion of the body 150 of the valve. This body 150 has an extremity 151 which is conjugate in form with that of the hole arranged in the support cylinder 10 to assure an indexation.

The bushing 144 of the scat 134 is of a shape uniform with the cylindrical interior passage 148, conjugate with that of the body of the valve 136. A collar 153 forming an abutment is added on the body and joined together with it to prevent the passage of this valve body 150 across the passage 148, and above all to form tightness with the face opposite the seat 134.

This arrangement also provides resources 160 for locking in place which include a pin 162 arranged transversely in relation to the body 150 of the valve immediately above the collar 153 provided to interact with an open compartment 164 adapted in shape to receive this pin in a first given angular position.

In this position, shown on FIG. 7A, the valve is in high position and the collar is tight with the face of the bushing 144 opposite. The compressed air will reinforce this laying on effect. In this case, there is formation of a film of air between the sleeve 22 and the support cylinder 10 in the case where the chamber 16 constituted by the hollow interior of the support cylinder is fed with compressed air.

When the sleeve is to be immobilized, it suffices, after having positioned the sleeve in relation to the support cylinder as a result of some outside marks, to have the valve turn by means of a simple screwdriver blade, a slot 166 being arranged at the valve extremity on the head 152. The valve, once it is turned angularly, introduces a displacement between the pin 162 and the compartment 164 provided to receive it, with the result that the valve is held in the open position because the collar separated from the face of the seat bushing on which it was supported. Moreover, the extremity 151 of the valve body penetrates into the hole 17 arranged in the support cylinder which permits a good control of indexation.

The compensation sleeve is thus positioned and immobilized on the support cylinder 10. Furthermore, the compressed air admitted into the chamber 16 constituted by the hollow body of this cylinder passes through the compensation sleeve which permits installing the printing sleeve with its stereotype in an easy manner, as in the principal form of construction.

One will note that in this variant, it is certain that the compensation cannot in any case shift angularly in relation to the support cylinder, even during operation, which is especially noticeable for sleeves of large dimensions because the masses in play are vary significant and the precision of the dimensions are more difficult to respect.

Figure 9:
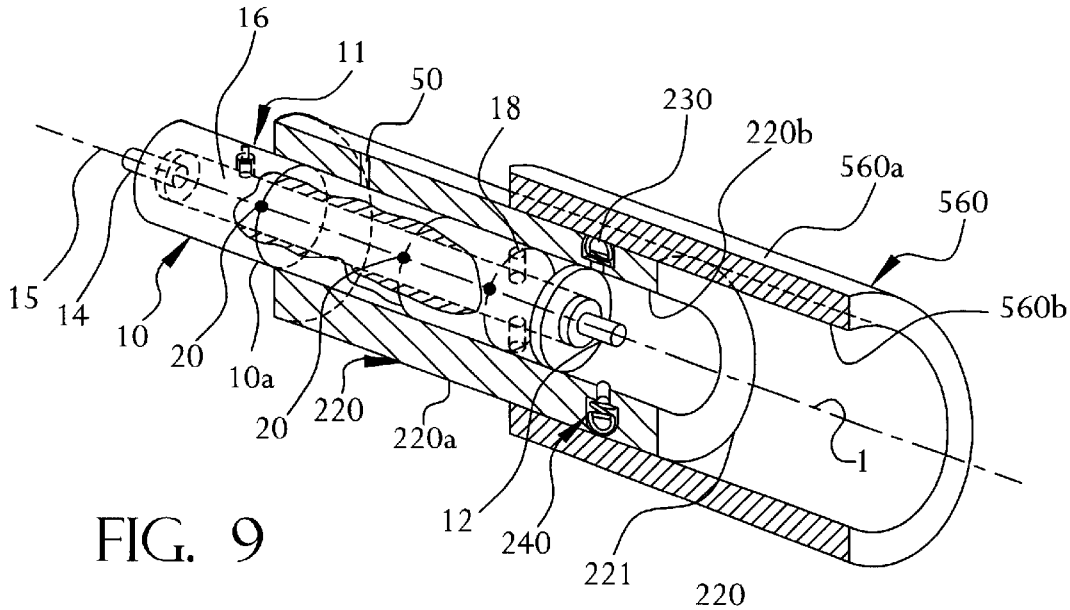
FIG. 9 is a schematic perspective view of a unit for a printing machine including a support cylinder, an intermediate sleeve of the invention and a printing sleeve.

FIG. 9 shows, in schematic form, a unit for a printing machine constituted by the support cylinder 10 in metal previously described, an intermediate sleeve 220 of the invention and a printing sleeve 560 whose thickness is defined by the distance between the exterior surface 560*a* and the interior surface 560*b*.

These three elements arc installed coaxially, the overall axis bearing the reference number 1.

The intermediate or compensation sleeve 220 has nozzles or channels distributed in a first set 240 situated near one of the extremities 221 of the sleeve. The walls of these channels 240 are air tight.

The traversing channels 240 extend radially across the thickness of the intermediate sleeve 220. The invention is not limited, however, to this embodiment. The channels 240 can form a different angle than 90° in relation to the axis 1 of the intermediate sleeve.

In the example illustrated on FIGS. 9 to 12, a closing device is placed in the interior of these two channels 240. The support and the interior passage are not explicitly depicted because they are formed by the channel 240 itself. The valves 230 schematically illustrated on FIGS. 9 to 13 are ball valves, but the invention is not limited to this type of valves.

The valves are fixed by any means appropriate, such as screws, glue, etc. . . . These valves are standard, which allows reducing the cost of manufacture of the intermediate sleeve as well as the cost of the maintenance requiring the replacement of a valve.

The compensation sleeve 220 illustrated on FIGS. 9 to 12 only has nozzles or channels in the proximity of one extremity 221 of this sleeve. This sleeve could likewise, like sleeve 22 illustrated in FIG. 2, include other traversing opening along the length of the sleeve. In this case, the openings are likewise equipped with a closing device, like the ball valve illustrated on FIGS. 9 to 12.

The valve 230 includes a head or active extremity 231, here constituted by a ball, which is elastically stressed by a spring 232 of such a sort that the ball 231 is supported on a seat 233 while being flush with the outer surface 220*a* of the intermediate sleeve 220.

Figure 10:
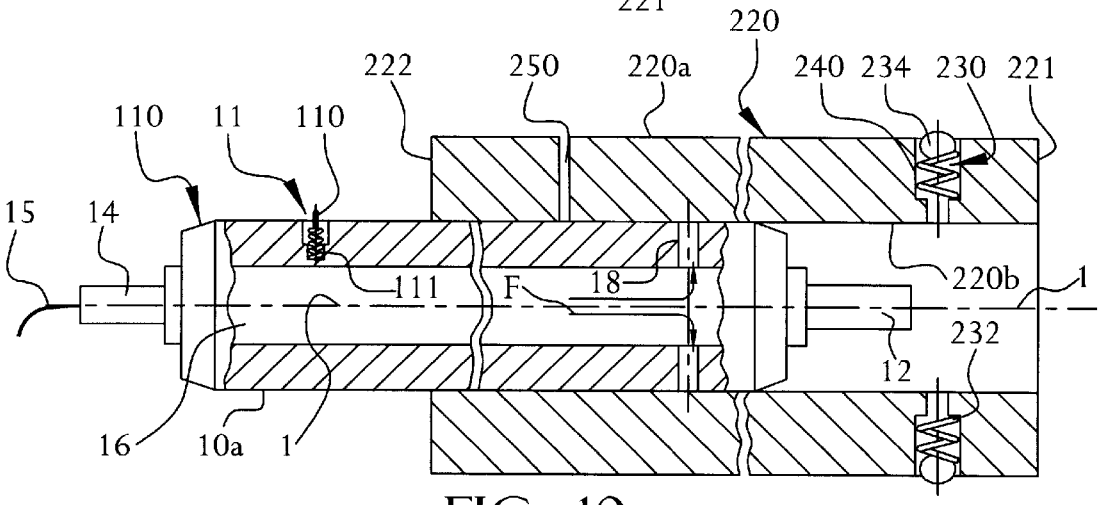
FIG. 10 is a view in longitudinal section of an intermediate sleeve of the invention in the process of installation on a support cylinder.
Figure 11:
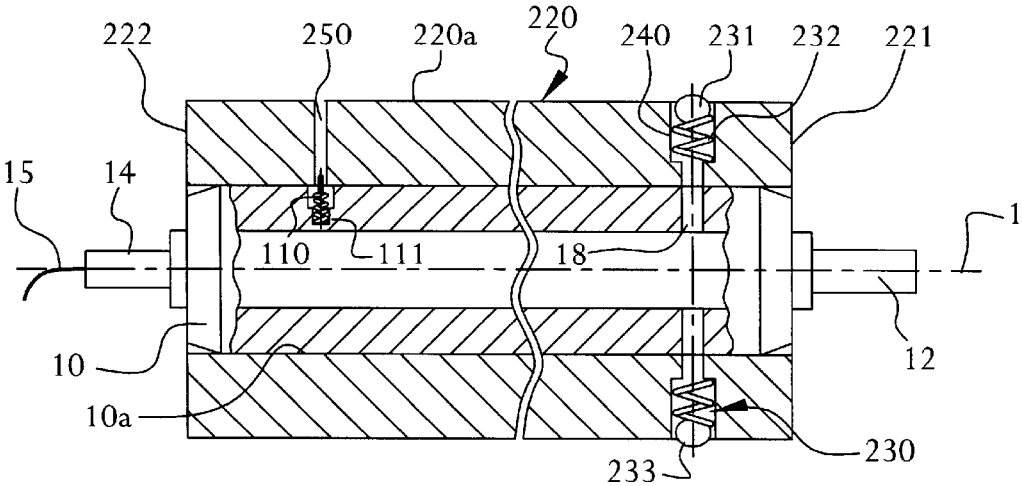
FIG. 11 is a view similar to FIG. 10 in which the intermediate sleeve is mounted on the cylinder.

As FIGS. 10 and 11 show, the active extremity 231 of the valve slightly overshoots the outer surface 220*a* of the sleeve. Otherwise, sleeve 220 includes an opening 250 the function of which will be discussed subsequently.

As previously explained, to install the intermediate sleeve on the support cylinder, some compressed air is introduced at the interior of the cylinder 10. This air under pressure passes through these traversing nozzles or openings 18 of the cylinder 10, as the arrows F show.

One then puts on the intermediate sleeve 220 by its other extremity 222 on the extremity of the cylinder 10 at the level of which the openings 18 are located.

The film of air between the outer surface 10*a* of the cylinder 10 and the internal surface 220*b* permits the insertion of the intermediate sleeve and sliding it onto cylinder 10.

FIG. 11 shows the intermediate sleeve 220 after its installation on cylinder 10, the supply of air having been cut off. The interior diameter of the sleeve 220 is chosen such that it is installed radially tight on the cylinder.

One will immediately note that during installation of the sleeve 220 on the cylinder, the channels 240 are closed owing to the ball 231 being supported on its seat 233. Thus, the air circulating through the openings 18 of the cylinder 10 cannot issue on the outer surface 220*a* of the intermediate sleeve 220. The film of air between the cylinder and the sleeve is thus not disturbed when the channels 240 move opposite cylinder 10.

Otherwise, cylinder 10 is outfitted with at least one device 11 designed to interact with the opening 250 of the intermediate sleeve 220 to constitute devices of locking the intermediate sleeve on the support.

Figure 12:
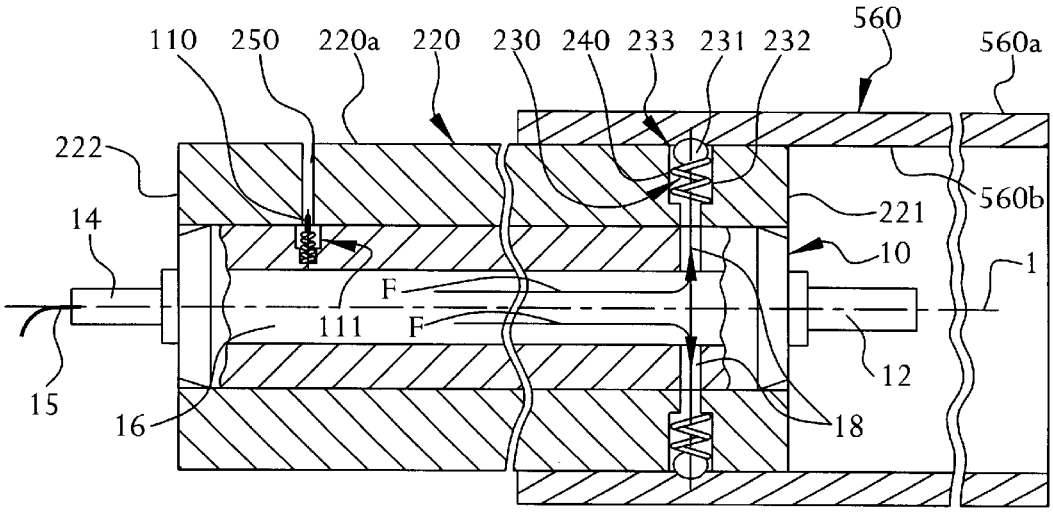
FIG. 12 is a view in longitudinal section of a printing sleeve in the process of installation on a unit consisting of a support cylinder and an intermediate sleeve of the invention.

In the example of construction illustrated on FIGS. 10 to 12, the device 11 is constituted by a digit 110 which is elastically pulled upon by a spring 111 to protrude in relation to the exterior surface 10*a* of the cylinder.

When the sleeve 220 passes over digit 110, it exerts a pressure upon this which induces the retraction of the digit into the cylinder, the digit 110 is subsequently inserted into the opening 250 provided in the intermediate sleeve 220.

The invention is certainly not limited to this mode of construction of means of locking which could, for example, consist of a bayonet system which is not illustrated in the figures.

The placement of the locking resources on the sleeve and on the cylinder is chosen such that, when the sleeve 220 is installed on the cylinder 10, at least one part of the traversing channels 240 of the intermediate sleeve 220 is in communication with the traversing openings 18 of cylinder 10.

One can likewise provide a system, namely electronic, indicating that the locking of the intermediate sleeve 220 on the cylinder 10 has been realized.

These locking resources equally assure that the intermediate sleeve 220 is fixed in position in relation to cylinder 10.

Referring now to FIG. 12, the installation of an exterior printing sleeve 560 on an intermediate sleeve 220 is described.

Some compressed air is again introduced into cylinder 10. It circulates according to arrows F indicated in FIG. 12 and passes by the openings 18 constructed in cylinder 10 and the channels 240 of the intermediate sleeve 220. The printing sleeve 560 is then put on the intermediate sleeve 220 by its extremity 221. The printing sleeve 560 comes into contact on the active extremity 231 of the anti-return valves 230, and this active extremity 231 is thus not resting on its seat 233. As a consequence, the air under pressure can issue on the exterior surface 220*a* of the sleeve 220 and thus create a film of air between the sleeve and the interior surface 560*b* of the printing sleeve 560. This film of air allows the printing sleeve to slide easily on the intermediate sleeve 220.

After having placed the printing sleeve 560 on the intermediate sleeve 220, the compressed air supply of the cylinder 10 is cut off.

The interior diameter of the printing sleeve 560 is selected such that it is installed radially tight on the intermediate sleeve 220.

The intermediate sleeve 220 and the printing sleeve 560 are thus joined with the cylinder 10 of the printing machine during the operation of the machine.

Figure 14:
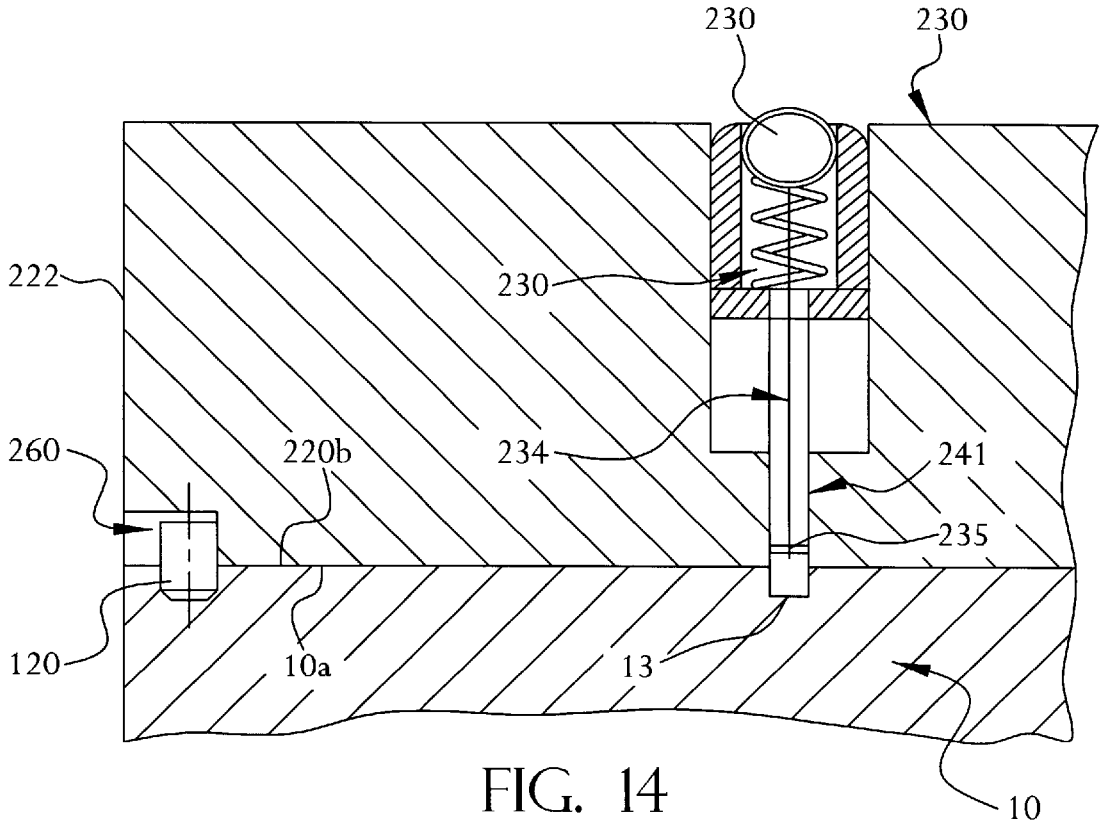
FIG. 14 is a partial view in longitudinal section of a construction variant of the locking resources of the intermediate sleeve on the cylinder before installation of the printing sleeve.
Figure 15:
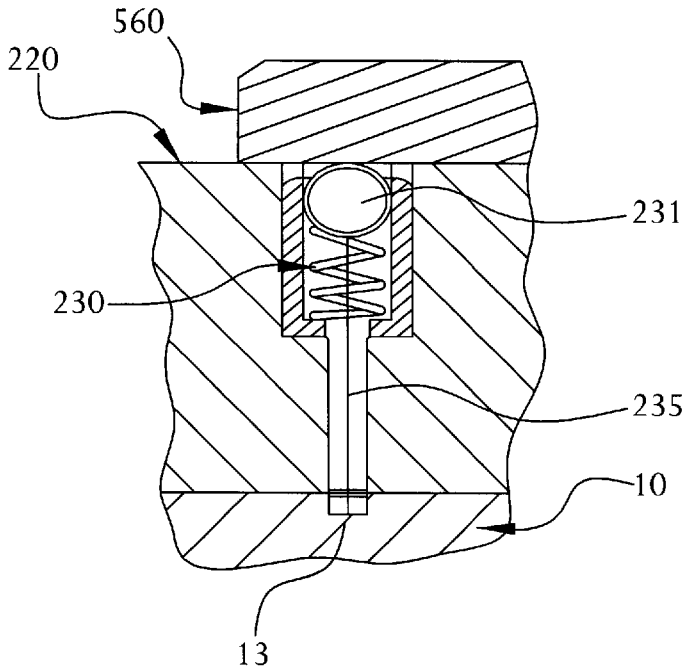
FIG. 15 is a partial view of FIG. 14 during installation of the printing sleeve.

One can likewise refer FIGS. 14 and 15 which illustrate other means of locking the sleeve 220 on the cylinder 10.

These devices include on the one hand a nipple 120 which is fixed on the cylinder so as to protrude in relation to the exterior surface 10*a* of the cylinder and on the other, a recess or facing 260 executed in the intermediate sleeve 220 issuing at one and the same time on the interior surface 220*b* and on the extremity 222 of the sleeve.

The intermediate sleeve is installed as previously explained on the cylinder 10, and at the end of installation, the nipple 120 will embed itself into the facing 260.

The interaction of the nipple 120 and the facing 260 permits locking the intermediate sleeve 220 on the cylinder 10, at one and the same time in rotation and according to the axis 1 of the cylinder in the direction of installation.

The blockage of the intermediate sleeve 220 on the cylinder 10 according to axis 1 and in the inverse direction of assembly is achieved during the installation of the exterior sleeve 560 as a result of devices which will now be described.

A rod or the like 234 is made integral with the ball 231 of the anti-return valve 230. It can include a protuberance 235 on its free end.

Otherwise, a recess 13 is provided in the cylinder 10. This recess is positioned on the cylinder such that the free extremity of the rod 234 is opposite this recess when the intermediate sleeve is installed on the cylinder. The length of the rod 234 is such that its extremity is retracted into the conduit in this position.

The provision of air by the anti-return valve and the channel 240 are not represented on FIGS. 14 and 15.

In another embodiment, one does not provide a recess 13 in the cylinder, and the rod 234 is designed to be opposite a traversing opening 18 of the cylinder. The channel 240 in which the valve is housed then replaces conduit 241.

As FIG. 15 shows, when the outer sleeve 560 is mounted on the intermediate sleeve 220, it comes into contact on the active extremity or ball 231 of the anti-return valve. The rod 234 is then driven into the recess 13 of the cylinder 10.

The interaction of the rod 234 and the recess 13 permits locking the intermediate sleeve 220 on the cylinder 10 according to the axis 1 of the cylinder and in the inverse direction of installation of the intermediate sleeve 220.

One may note that this variant of construction of the anti-return valve 230 with the rod 234 can likewise be used with the locking resource constituted by the digit 110 of the cylinder 10 interacting with the opening 250 of the intermediate sleeve 220 as described in reference to FIGS. 9 to 12. In this case, the rod 234 contributes an additional blockage of the intermediate sleeve on the cylinder during installation of the exterior sleeve.

Dismounting the printing sleeve 560 and of the intermediate sleeve 220 is accomplished by proceeding to the operations described above in inverse order.

With a single intermediate sleeve 220 resting installed on the cylinder 10, the printing sleeve 560 can be dismounted and replaced by another printing sleeve to change the printing design or furthermore to install a printing sleeve the outside diameter of which corresponds to the desired development.

The printing sleeve 560 presents a relatively small thickness and low weight and can thus easily be manipulated by an operator.

Following a production sequence of the printing machine and its cessation, the intercalary sleeve can, like the printing sleeve 560, be unlocked and dismounted to be stored with a view toward a future use.

In the embodiment illustrated in FIGS. 9 to 12, unlocking the intermediate sleeve is realized by pushing the digit 110 across the opening 250 so that it will be embedded in cylinder 10.

In the example illustrated in FIGS. 14 and 15, no particular operation should be executed to unlock the sleeve 220. Once the outer sleeve 560 is dismounted from the intermediate sleeve, the rod 234 retracts into the sleeve 220, and it is enough to have the sleeve 220 slide on the cylinder 10 in the reverse direction to installation to remove it from the cylinder.

Figure 16:
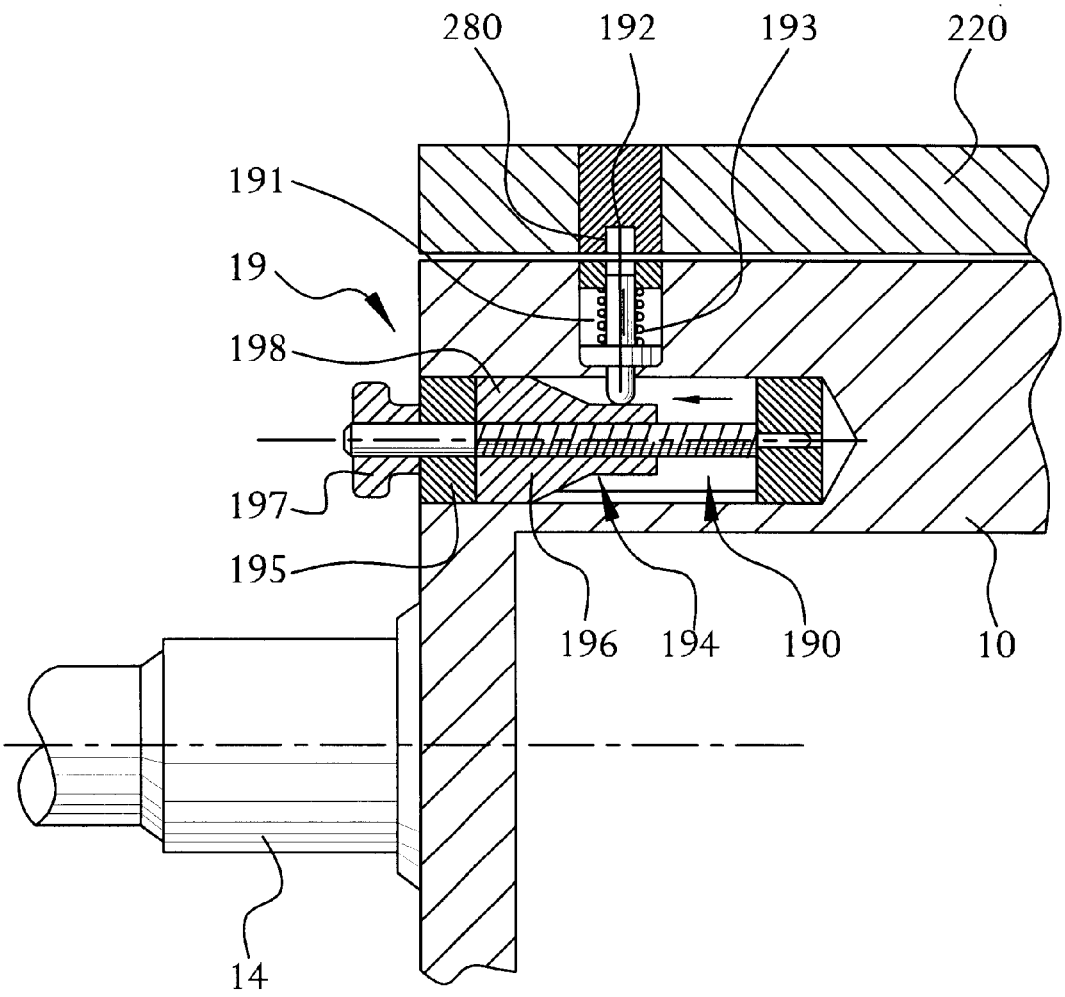
FIGS. 16 and 17 are two views in longitudinal section of an indexing and locking resource, in its two positions.
Figure 17:
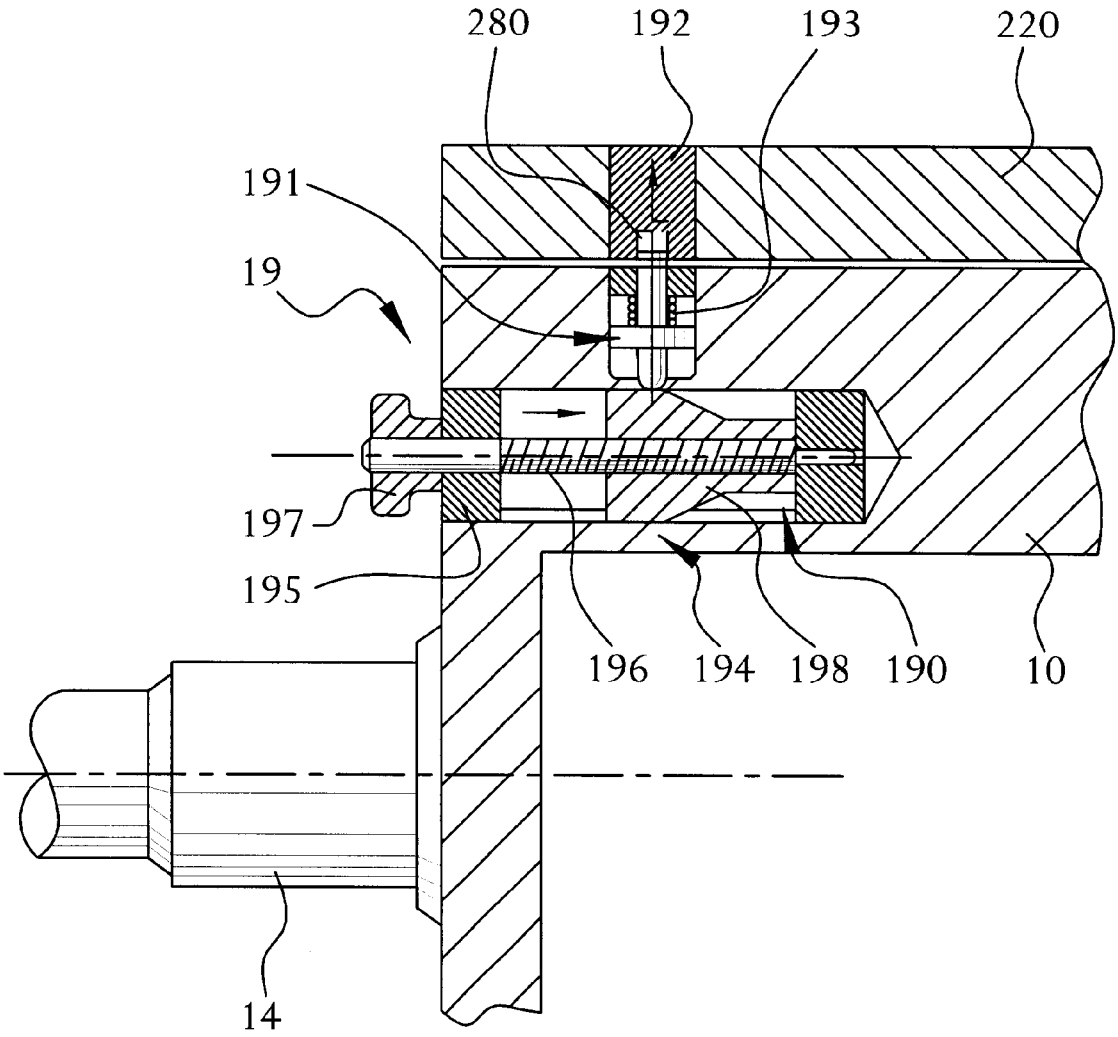

Referring now to FIGS. 16 and 17 that represent other resources 19 for indexing the compensation sleeve 220 in relation to the support cylinder 10, these devices likewise serve to lock the sleeve on the support cylinder after installing it.

Such means are interposed between the different closing devices if the compensation sleeve is equipped with several of them. Moreover, these devices are directly installed on the support cylinder 10.

These indexing devices include a first compartment 190 arranged in the thickness of the cylinder following the longitudinal axis as well as a second compartment 191, radial, issuing into the first compartment.

A mobile digit 192 in the second compartment 191 can assume two positions, the one retracted under the action of a return spring 193 and the other, protruding, under the effect of maneuvering devices 194.

These maneuvering devices 194 include, in one particular embodiment, an insert 195 screwed into the first compartment with a threaded shaft 196 which can turn under the manual action of the operator thanks to a knurled knob 197. This shaft is fixed in translation and receives a tapped slide block 198 with a first right cylindrical part and a second cylindrical-conical part installed by screwing on this shaft.

This slide block receives in contact the mobile digit 192 by its lower extremity.

This slide block can assume two extreme positions, one of which corresponds to an interaction of the mobile digit with the right cylindrical part (the digit is retracted—FIG. 16) and the other to a cooperation of the mobile digit with the cylindrical-conical part (the digit is in protrusion—FIG. 17).

It suffices to provide a hole or boring 280 issuing into the compensation sleeve 220 with a shape adapted to receive the upper extremity of this digit.

Thenceforth the penetration of the mobile digit is the guarantee of a good indexation.

According to one variant, the slide block can also be fixed on a sliding rod, not threaded, the movements of the slide block being linked to those of the sliding rod.

Figure 13:
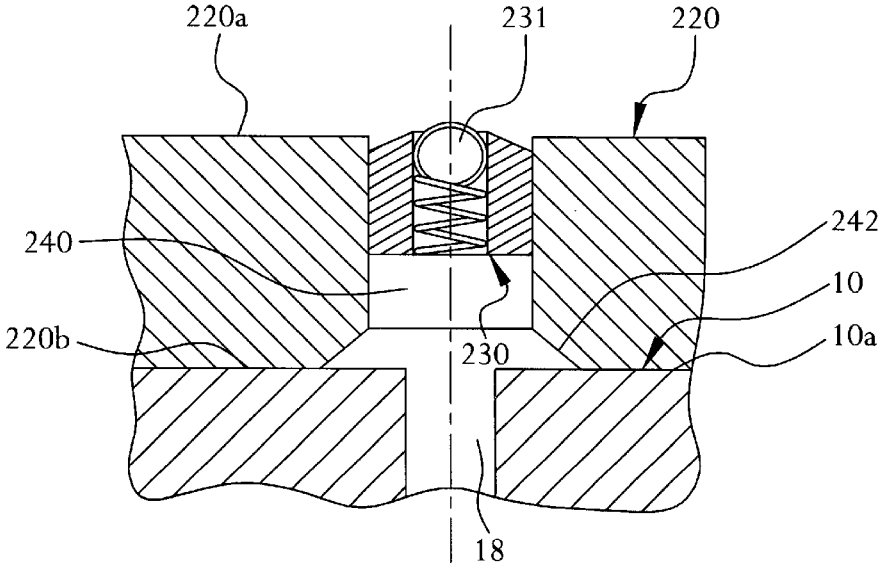
FIG. 13 is a view in longitudinal section showing a variant of constructing the intermediate sleeve of the invention.

Referring now to FIG. 13 which illustrates another embodiment of construction of a traversing channel 240 executed in the intermediate sleeve according to the invention.

An anti-return valve 230 is always installed in this channel 240 the active extremity 231 of which slightly protrudes in relation to the exterior surface 220*a* of the intermediate sleeve 220.

Contrary to the active extremity 231, the channel 240 issues on the interior surface 220*b* of the intermediate sleeve, the channel 240 being in communication with a traversing opening 18 of cylinder 10.

The channel 240 here includes a truncated part 242 which issues widening on the interior surface 220*b* of the sleeve.

This widening of the channel 240 permits correcting small defects in alignment between the channel 240 and the traversing opening 18 of the cylinder 10.

One can likewise provide, on the interior surface 220*b* of the intermediate sleeve, means of tightness associated with a channel 240 to avoid significant losses of pressure between the opening 18 and the channel 240. These means of tightening can assume the form of a joint realized on the interior surface 220*b* of the sleeve 220. These tightening resources are not illustrated in the figures.

For the rest, a channel 24, 240 of the intermediate sleeve 22, 220 can be equipped with two anti-return valves which it is capable of supplying with compressed air.

Moreover, the number of traversing channels 24, 240 provided on the intermediate sleeve 22,220 is not necessarily identical to the number of openings 18 provided in the cylinder 10. For example, a lower number of channels 240 can be sufficient to proceed to the installation of a printing sleeve 560.

In the examples described in the figures, the openings 18 of the cylinder 10 and the channels 24, 240 of the intermediate sleeve 22, 220 are radially distributed according to a transversal section of the cylinder or of the sleeve. The invention is not limited to this embodiment and other embodiments can be envisioned by those skilled in the art.

The intermediate sleeve of the invention preferably presents a more significant rigidity at the level of its outer surface than on the rest of its thickness.

The fact that the external surface of the intermediate sleeve presents a high rigidity to pressure permits an easy installation and dismounting of the outer printing sleeve.

It is indeed necessary that the interior surface of the intermediate sleeve can be slightly compressed to permit installation of the sleeve on the cylinder, but the exterior surface of this same sleeve should not be deformed during installation of the printing sleeve.

By preference, the outside diameter of the intermediate sleeve undergoes a deformation which is less than 0.02 millimeters under the effect of an air pressure of $6\times10^5$ Pa acting on the internal surface of the sleeve installed on the cylinder.

The thickness of the intermediate sleeve can fall between 10 and 70 millimeters thanks to the fact that an anti-return valve is a relatively slight encumbrance.

The interior diameter of the intermediate sleeve according to the invention can namely fall between 75 and 500 millimeters.

For the rest, the intermediate sleeve of the invention is preferably constructed of a light material the mean density of which falls between 0.25 and 0.9.

One will note that the automatic closing devices which have been described can be manufactured and installed in an insert then disposed on the cylinders or sleeves afterward.

In the case of a support cylinder prior to receiving a single sleeve, the closing resources are installed directly on the support cylinder because this improves the distribution of pressure and permits obtaining a film of air of better quality. The obturators arc then directly introduced into the thickness of the cylinder. In this case, it is still more judicious to have recourse to an insert which is screwed into a tapped machines hole in the thickness of the cylinder wall, this insert including the totality of support/seat/valve/spring elements which have just been described for the compensation sleeve.

In order to combat the risks of suppression, it is advisable to arrange on the cylinders some safety valves set at a maximum safety pressure above which the air under pressure will escape.

One will then note that such a valve can be constructed by means of a valve of the invention because it suffices to orient the support/seat/valve unit inside out and to install a spring with stronger rigidity set to correspond to the driven maximal pressure.

In the scope of associated refinements, it is also possible to arrange a ring of fibrous material of padding type at the extremity of the support cylinder so as to assure, conjointly with insertion, a cleaning of the interior of the sleeve to be installed, thus avoiding the presence of particles which can impair the good sliding of the sleeve on the cylinder. The overhang of such a rung should be several tenths seeing that these materials are compressible in great proportions.

What is claimed is:

1. A sleeve support to which a printing sleeve may be coupled, said sleeve support comprising:

a hollow cylinder defined by a substantially cylindrical sidewall having a thickness defined by the distance between an exterior surface and an interior surface, said sidewall having a plurality of air passages disposed therethrough, each one of the air passages having a closing device disposed therein, each one of the closing devices comprising:

a seat coupled with the sidewall; and a valve member having a body portion and a head portion, said valve member being movably disposed longitudinally within said air passage and is capable of assuming a first position wherein said head portion comes into contact with said seat, and a second position wherein said valve is retracted to permit a passage for pressurized gas.

2. The sleeve support of claim 1 wherein each one of said closing devices further comprises a spring having a first portion in contact with the valve member for urging the valve member toward said first position.

3. The sleeve support of claim 2 wherein the closing device further comprises a support coupled with the sidewall whereby a second portion of said spring is urging against said support.

4. The sleeve support of claim 3 wherein said support is disposed opposite said seat and said spring is helical and said spring's first portion is opposite said spring's second portion.

5. The sleeve support of claim 1 wherein the seat is adjacent to the exterior surface of said hollow cylinder and has an inner surface defining an interior passage.

6. The sleeve support of claim 5 wherein said head portion has a substantially conical contact surface, and said interior passage of said seat has a mating surface conjugate to the contact surface of said head when said head portion is in contact against said interior passage of said seat, slightly protruding in relation to said exterior surface when said head portion is in said first position.

7. The sleeve support of claim 1 wherein said head portion is substantially circular.

8. The sleeve support of claim 1 wherein said head portion comprises a collar to be laid in a tight manner against a face opposite said seat, and an element forming an abutment for angular displacement to assure tightness when said element forming an abutment is in a first angular position and such that a passage is generated by retraction of said collar in relation to said seat when said element forming an abutment is in a second angular position.

9. The sleeve support of claim 8 wherein said element forming an abutment is a pin transversal in relation to said valve member, and is provided to retreat into an open compartment conducted on said face opposite said seat in said first position.

10. The sleeve support of claim 8 or 9 wherein said head portion of said valve member includes a slot designed to interact with a maneuvering blade.

11. The sleeve support of claim 1 wherein said head portion is ball-shaped, wherein said ball-shaped head portion slightly protrudes in relation to the exterior surface of said hollow cylinder when it is laid against said seat.

12. A method for mounting a printing sleeve assembly comprising the steps of:

providing a support cylinder having a hollow interior and comprising an interior and exterior surface and a first set of transverse openings for the passage of air from said hollow interior, said support cylinder being capable of receiving a flow of pressurized air;

providing a flow of pressurized air to said interior surface of said hollow support cylinder such that said pressurized air escapes through said first set of transverse openings; and introducing a sleeve support over said first set of transverse openings, said sleeve support comprising:

a hollow cylinder defined by a substantially cylindrical sidewall having a thickness defined by the distance between an exterior surface and an interior surface, said sidewall having a plurality of air passages disposed therethrough, each one of the air passages having a closing device disposed therein, each one of the closing devices comprising:

a seat coupled with the sidewall; and a valve member having a body portion and a head portion, said valve member being movably disposed longitudinally within said air passage and is capable of assuming a first position wherein said head portion comes into contact with said seat, and a second position wherein said valve member is retracted to permit a passage for pressurized gas to escape, whereby said escaping pressurized air causes said head portion of said valve member to come into tight contact with said seat thereby preventing the escape of air through said plurality of air passages in said sleeve support and generating a film of air between said outer surface of said support cylinder and said interior surface of said sleeve support.

13. The method of claim 12 further comprising the steps of:

interrupting the flow of pressurized air after said sleeve support is introduced;

introducing a printing sleeve onto said sleeve support such that said head portions of said valve members of said closing devices are retracted to permit the flow of pressurized air through said plurality of air passages in said sleeve support; and resuming the flow of pressurized air whereby said flow of pressurized air passes through said plurality of air passages in said sleeve support thereby forming a film of pressurized air between said sleeve support and said printing sleeve to mobilize said printing sleeve.

14. The method of claim 13 wherein the printing sleeve includes at least one printing plate.

15. The method of claim 12 wherein said head portion is the shape of a cone, and said seat is outfitted with an interior passage conjugate in form to that of said head portion to assure a tightness when said head portion is in contact against said seat in said interior passage.

16. The method of claim 12 wherein said head portion comprises a collar to be laid in a tight manner against a face opposite said seat, and an element forming an abutment for angular displacement to assure tightness when said element forming an abutment is in a first angular position and such that a passage is generated by retraction of said collar in relation to said seat when said element forming an abutment is in a second angular position.

17. The method of claim 16 wherein said element forming an abutment is a pin transversal in relation to said valve member, and is provided to retreat into an open compartment conducted on said face opposite said seat in said first position.

18. The method of claims 16 or 17 wherein said head portion of said valve member includes a slot designed to interact with a maneuvering blade.

19. The method of claim 12 wherein said head portion is ball-shaped that slightly protrudes in relation to the outer surface of the hollow cylinder when said ball-shaped head portion is laid against the seat.

20. A method for mounting a printing sleeve assembly onto a sleeve support, comprising the steps of:

providing a sleeve support comprising an interior surface and an exterior surface, a hollow interior, and a plurality of passages formed between said interior and exterior surfaces for enabling air communication therethrough, each one of said passages including a valve assembly disposed therein that is biased toward a closed position;

providing pressurized air to said passages;

sliding an open end of a printing sleeve longitudinally over said sleeve support;

moving said printing sleeve longitudinally over said sleeve support, said sleeve support contacting a portion of said valve assembly to urge said valve assembly from its closed position to an open position to enable the pressurized air to communicate with said printing sleeve; and turning off the pressurized air after said printing sleeve is disposed in its desired position relative to said sleeve support.

21. The method of claim 20 wherein the printing sleeve includes at least one printing plate.

* * * * *